United States Patent [19]

Harrington et al.

[11] 3,991,240

[45] Nov. 9, 1976

[54] COMPOSITE IRON MOLYBDENUM BORON FLAME SPRAY POWDER

[75] Inventors: John H. Harrington, Warwick; Frank N. Longo, East Northport, both of N.Y.

[73] Assignee: Metco, Inc., Westbury, N.Y.

[22] Filed: Feb. 18, 1975

[21] Appl. No.: 550,404

[52] U.S. Cl. ..... 427/423; 29/192 CP; 75/.5 BA; 75/.5 R; 427/191

[51] Int. Cl.[2] ..... B22F 1/02; B05B 7/20

[58] Field of Search ..... 427/191, 423; 75/.5 R, 75/.5 BA; 29/192 CP, 191.2

[56] References Cited

UNITED STATES PATENTS

| | | | |
|---|---|---|---|
| 2,219,462 | 10/1940 | Wissler | 29/191.2 |
| 2,694,647 | 11/1954 | Cole | 427/191 |
| 3,025,182 | 3/1962 | Schrewelius | 427/423 |
| 3,275,426 | 9/1966 | Rowady | 75/.5 R |
| 3,322,546 | 5/1967 | Tanzman et al. | 75/.5 R |
| 3,428,442 | 2/1969 | Yurasko, Jr. | 427/423 |

*Primary Examiner*—Stallard W.
*Attorney, Agent, or Firm*—Burgess, Dinklage & Sprung

[57] ABSTRACT

A composite flame spray powder comprising powder particles having as components, cast iron, molybdenum (as such and/or as ferromolybdenum), and boron (as such and/or as ferroboron), unalloyed together. The composite particles are preferably in a form having a cast iron core, of a size between −170 mesh standard screen size and +15 microns, with particles of molybdenum and boron of a size between about −20 and +0.1 microns, bound to the surface of the cast iron core with a binder, the molybdenum being present in amounts of about 20% by weight and the boron in amounts of about 1% by weight based on the total of the cast iron and molybdenum. When flame sprayed, the composite particles produce a coating having high wear and scuff resistance characteristics and low friction.

11 Claims, No Drawings

COMPOSITE IRON MOLYBDENUM BORON FLAME SPRAY POWDER

This invention relates to composite flame spray powder containing inexpensive cast iron as a major component, and yet which is capable, upon flame spraying, of producing a hard, wear- and scuff-resistant coating which finishes well and shows good bearing characteristics.

In the flame spray art, it is well-known to flame spray various types of metal powders, blends and composites depending on the type and characteristics of the flame sprayed coating to be produced.

In order to produce hard, wear- and scuff-resistant coatings which could be ground to a good finish and could be utilized in machinery as a long-wearing bearing surface, it was generally necessary to utilize relatively expensive metals as, for example, molybdenum, nickel-base self-fluxing alloys, and the like.

Attempts to reduce the cost of such flame spray material as, for example, by blending the relatively expensive molybdenum with relatively inexpensive cast iron did not prove satisfactory and the coatings produced upon spraying such blends did not show all of the desired characteristics.

One object of this invention is a flame spray material containing relatively inexpensive cast iron as a major component, and yet which, upon flame spraying, is capable of producing a hard, wear-resistant and scuff-resistant coating which may be ground to a smooth finish and which makes an excellent bearing surface for use between moving parts of machine elements. This and still further objects will become apparent from the following description.

In accordance with the invention, it has been discovered that a hard, wear-resistant, scuff-resistant coating which may be ground to a good finish and which is excellently suited as a bearing surface between moving parts of machine components may be obtained utilizing a flame spray material containing inexpensive cast iron as a major constituent, if the flame spray material is in the form of a composite powder the individual particles of which contain, in addition to the cast iron, molybdenum and boron.

The term "cast iron" as used herein and in the claims designates an alloy of iron and carbon usually containing various quantities of silicon, manganese, phosphorus and sulfur, with the carbon present in excess of the amount which can be retained in solid solution in austenite at the eutetic temperature. Alloy cast irons have improved mechanical properties, such as corrosion-, heat- and wear-resistance, and the addition of alloying elements have a marked effect of graphitization. Other common alloying elements in cast iron include molybdenum, chromium, nickel, vanadium, and copper.

A composite flame spray powder, as the term is understood in the flame spray art, designates a powder, the individual particles of which contain several components which are individually present, i.e., unalloyed together, but connected as a structural unit forming the powder particles.

The composite flame spray particles, in accordance with the invention, thus must contain the cast iron, a molybdenum component, and a boron component, unalloyed together, but structurally united in each individual particle.

The individual components may be combined in any known or desired manner to form the composite particles, as for example, in the form of aggregates, or the like, but preferably, in accordance with the invention, the composite is in the form of a clad powder, the individual particles consisting of a cast iron core with a coating containing the molybdenum component and boron component, most preferably in the form of individual small particles of molybdenum and boron components bound to the surface of the cast iron core with a binder.

The molybdenum component may consist of molybdenum per se and/or a ferromolybdenum alloy containing at least 50% Mo, and preferably from 55 to 75% Mo.

The boron component may consist of boron itself and/or a ferroboron alloy containing from 10 to 30% boron, based on the alloy, and preferably 18% boron.

The composite flame spray powder particles in accordance with the invention should contain at least 50% by weight cast iron, about 10 to 50% by weight, preferably 15 to 30% by weight, and most preferably about 20% by weight molybdenum, about 0.1 to 3% by weight of boron, and preferably 1% by weight of boron, all based on the combined total weight of the cast iron and molybdenum.

The individual particles should have a size and a classification as is conventional in the flame spray art, as for example, a size between about −60 mesh U.S. standard screen size and +3 microns, and preferably of a size between −140 mesh and +10 microns.

Most preferably, composite flame spray powder is formed by cladding or coating white cast iron powder of a size between about 170 mesh U.S. standard screen size and +15 microns with 20% by weight of molybdenum and 1% by weight of boron based on the total of the cast iron and molybdenum, both of a size of −325 mesh, and preferably between about −20 and +0.1 microns.

The cast iron may be coated or clad with the finer molybdenum and boron particles in any known or conventional manner, as for example, by mixing the molybdenum and boron in a binding agent, such as a varnish or lacquer, blending the same with the cast iron and drying or setting the binder.

Most preferably, as a binder there may be used a conventional phenolic varnish.

Other examples of binders include conventional epoxy or alkyl varnishes, varnishes containing drying oil, such as tung oil, linseed oil, rubber and latex binders, and the like. The binder may contain a resin which does not depend on solvent evaporation in order to form a dried or set film. The binder may thus contain a catalyzed resin.

The term "coating" or "cladding" as used herein is used in its conventional sense as is understood in the flame spray art and does not require a uniform or contiguous coating or cladding and simply designates the form in which the finer particles are so-to-speak adhered to the surface of the cast iron.

The powders are sprayed in the conventional manner using a powder-type flame spray gun, though it is possible to combine the powder in the form of a wire or rod using a binder, such as a plastic or rubber, and spraying the same with a wire-type flame spray gun. The spraying should preferably be effected with flame spray equipment which is capable of producing sufficient heat to cause at least the heat softening of the molybdenum component of the composite. It has been found preferable to effect the spraying with a plasma-type flame spray gun.

The flame sprayed coatings formed are extremely hard and wear-resistant, show excellent scuff-resistance and have superior finishing capabilities, being capable of being ground wet with a 60 grit silicon carbide wheel to a smooth finish of, for example, 5 to 20 microinches AA (arithmetic average) as determined with standard Profilometer Model QC (made by Micrometrical Manufacturing Co., Ann Arbor, Michigan) using 0.030 inch cutoff.

The coatings are excellently suited as bearing and wear surfaces on machine components as, for example, for coating the circumference of piston rings, cylinder walls, piston skirts, rotary engine trochoids, seals and end plates, crankshafts, roll journals, bearing sleeves, impeller shafts, gear journals, fuel pump rotors, screw conveyors, wire or thread capstans, brake drums, shifter forks, doctor blades, thread guides, farming tools, motor shafts, lathe ways, lathe and grinder centers, cam followers, and cylinder liners.

The molybdenum component, when combined with the cast iron in the composite form, and preferably as the cladding or coating, acts to substantially reduce the amount of decarburization during the spraying, and the boron appears to act as an interstitial hardner and agent for increasing the coating density and integrity. Overall the components act in conjunction with each other in the particular flame spray form to produce a superior, hard, high-scuff- and wear-resistant coating.

The following examples are given by way of illustration and not limitation:

EXAMPLE 1

1785 grams of cast iron powder of a size between −170 mesh U.S. standard screen size and +15 microns is mixed in a pot at room temperature with about 227 grams of a conventional phenolic varnish having approximately 10% solids for five minutes. 454 grams of molybdenum powder and 22.7 grams of boron powder both of a size between −20 and +0.1 microns are slowly added and mixed-in thoroughly. The wet slurry is then heated while stirring until a dry mixture is produced. The mixture is then thoroughly dried in an oven at a temperature of about 175° F and screened through a 170 mesh screen to remove any larger agglomerates. There is thus produced a composite flame spray powder having core particles of cast iron clad with the finer molybdenum and boron particles.

This flame spray powder is then sprayed with a plasma, powder-type flame spray gun that is marketed by Metco, Inc. of Westbury, Long Island, under the designation of the type 3MB Plasma gun utilizing a GE nozzle, a number 2 powder port, with argon as the primary gas at a pressure of 100 pounds per square inch gauge and a flow rate of 80 standard cubic feet per hour, and utilizing as a secondary gas, hydrogen at a pressure of 50 pounds per square inch and a flow rate of 20 standard cubic feet per hour. The plasma gun is operated at an amperage of 500 amps and a voltage of 65 volts utilizing a carrier gas flow of 15 standard cubic feet per hour. The powder is fed through the gun at a spray rate of 10 pounds per hour onto a mild steel substrate which has been prepared by blasting with steel grit propelled with air at a pressure of 90 pounds per square inch. Auxiliary jets of air are directed at the substrate for cooling, but not so as to interfere with the spray stream.

The coating is formed having a thickness of 0.03 to 0.05 inches and is ground to a finish of between 10 and 20 microinches AA as measured with a standard Profilometer Model QC, using 0.030 inch cutoff.

The final coating has a thickness of 0.002 to 0.040 inches and a hardness as measured on the Rockwell C scale of ≈50. It has excellent wear-resistance and scuff-resistance.

The powder may be used for coating piston rings, or for other applications previously listed.

EXAMPLE 2

A coating sprayed with a powder similar to Example 1, but with 30% molybdenum and ½% boron, is very similar but has only 90% of the wear-resistance of the coating of Example 1.

An analogous coating formed from neat, white cast iron only shows a Rockwell hardness on the C scale of 43 and only shows about 70% of the wear-resistance of the coating of Example 1, and poor scuff-resistance.

A blend of white cast iron and molybdenum containing 30% molybdenum and sprayed in an analogous manner only shows a Rockwell hardness on the C scale of 40, only 60% of the wear-resistance of the coating of Example 1, and less scuff-resistance.

A blend of 75% molybdenum and 25% self-fluxing alloy, when sprayed in analogous manner, produced a coating having a Rockwell C scale hardness of 44, and a wear-resistance of 50% of the coating of Example 1.

Molybdenum wire, when sprayed under analogous conditions, produced a coating having a Rockwell C scale hardness of 40, a wear-resistance of 50% of the coating of Example 1, and only could be finished to a finish of 25–40 microinches AA.

EXAMPLE 3

A coating powder was produced exactly as described in Example 1, except the boron was omitted. The powder was sprayed in an identical manner to that described in Example 1, and the coating produced had a Rockwell C scale hardness of 42, a wear-resistance of about 60% of that shown for the coating formed in accordance with Example 1, and fair scuff-resistance.

EXAMPLE 4

80% by weight of white cast iron powder of a particle size between about −170 and +325 mesh U.S. standard screen size is combined with 15% by weight of low carbon ferromolybdenum alloy containing 62% by weight of molybdenum and having a particle size of −15 $\mu$ and 5% by weight of ferroboron alloy containing 18% by weight of boron and having a particle size of −15 $\mu$. A slurry is formed of these components in 6% by weight of a phenolic varnish containing approximately 10% solids, with thorough mixing, which is continued until a dry mixture is obtained, which consists of the cast iron powder granules clad with the finer particles of the ferromolybdenum alloy and ferroboron alloy. The powder is flame sprayed, as described in Example 1. A coating is formed having a thickness of 0.060 inches, which is ground to a finish between about 8 and 20 microinches AA. The final coating has a thickness of 0.050 inches and a hardness as measured on the Rockwell C scale of 55, and has excellent wear-resistance and scuff-resistance, the wear-resistance being 40% better than that shown for the coating of Example 1.

While the invention has been described in detail with reference to certain specific embodiments, various changes and modifications will become apparent to the skilled artisan, which fall within the scope and spirit of the appended claims.

What is claimed is:

1. A composite flame spray powder, the individual particles of which contain as components, unalloyed together, a cast-iron component, a molybdenum component, and a boron component, said molybdenum component being selected from the group consisting of molybdenum and ferromolybdenum alloy, said boron component being selected from the group consisting of boron and ferroboron alloy, the powder containing about 10 to 50 % by weight of the molybdenum and about 0.1 to 3 % by weight of boron, based on the combined total weight of the cast iron and molybdenum, the cast iron component being present in amount of at least 50% by weight.

2. Composite flame spray powder according to claim 1, in which the particles have a cast iron core and a coating containing the molybdenum and boron components.

3. Composite flame spray powder according to claim 2, in which said cast iron core has a particle size between about −170 mesh and +15 microns and is coated with a binder containing fine molybdenum and boron component particles.

4. Composite flame spray powder according to claim 1, the individual particles of which have a white cast iron core of a size between −170 mesh and +15 microns and contain particles of the molybdenum and boron components of a size between about −20 microns and +0.1 microns bound to the surface of the cast iron core with a binder, the molybdenum being present in an amount of about 20% by weight of the total of the cast iron and molybdenum, and the boron being present in an amount of about 1% by weight, based on the combined total weight of the cast iron and molybdenum.

5. Composite flame spray powder according to claim 1, in which said molybdenum component is a ferromolybdenum alloy containing from 55 to 75 % by weight of molybdenum.

6. Composite flame spray powder according to claim 1, in which said boron component is a ferroboron alloy containing about 10 to 30 % by weight of boron.

7. Composite flame spray powder according to claim 6, the individual particles of which have a white cast iron core of a size between −170 mesh and +15 microns and contain particles of the molybdenum and ferroboron alloy of a size between −20 microns and +0.1 microns, bound to the surface of the cast iron core with a binder, the molybdenum being present in an amount of about 20% by weight of the total of the cast iron and molybdenum, and the boron being present in an amount of about 1% by weight, based on the combined total of the cast iron and molybdenum.

8. In the flame spray process in which a flame spray material was heated to at least its softening temperature and propelled against the surface to be coated, the improvement which comprises spraying a composite flame spray powder, the individual particles of which contain as components, which are unalloyed together, a cast iron component, a molybdenum component, and a boron component, the molybdenum component being selected from the group consisting of molybdenum and ferromolybdenum alloy, and the boron component being selected from the group consisting of boron and ferroboron alloy, the powder containing about 10 to 50 % by weight of molybdenum and about 0.1 to 3 % by weight of boron, based on the combined total weight of the cast iron and molybdenum.

9. Improvement according to claim 8, in which the flame spray powder is a clad powder, the individual particles of which have a cast iron core of a size between about −170 mesh and +15 microns, having particles of the molybdenum and boron components of a size between about −20 microns and +1 microns bound to the surface of the cast iron core with a binder.

10. Improvement according to claim 9, in which the molybdenum component is a ferromolybdenum alloy having about 55 to 75 % by weight of molybdenum.

11. Improvement according to claim 9, in which the boron component is a ferroboron alloy containing about 10 to 30 % by weight of boron.

* * * * *